US011441274B2

(12) United States Patent
Schuh et al.

(10) Patent No.: US 11,441,274 B2
(45) Date of Patent: Sep. 13, 2022

(54) TISSUE PRODUCTS HAVING EMBOSS ELEMENTS WITH REDUCED BUNCHING AND METHODS FOR PRODUCING THE SAME

(71) Applicant: GPCP IP Holdings LLC, Atlanta, GA (US)

(72) Inventors: Brian J. Schuh, Appleton, WI (US); Steven R. Olson, Madison, WI (US); Michael D. Wishneski, Oconto, WI (US); Eric A. Stuart, Appleton, WI (US)

(73) Assignee: GPCP IP Holdings LLC, Atlanta, GA (US)

( * ) Notice: Subject to any disclaimer, the term of this patent is extended or adjusted under 35 U.S.C. 154(b) by 0 days.

(21) Appl. No.: 17/149,174

(22) Filed: Jan. 14, 2021

(65) Prior Publication Data

US 2021/0285161 A1 Sep. 16, 2021

Related U.S. Application Data

(60) Provisional application No. 62/990,152, filed on Mar. 16, 2020.

(51) Int. Cl.
*D21H 27/40* (2006.01)
*D21H 27/00* (2006.01)
(Continued)

(52) U.S. Cl.
CPC ..... *D21H 27/40* (2013.01); *B31F 1/07* (2013.01); *D21F 11/006* (2013.01);
(Continued)

(58) Field of Classification Search
CPC ..... D21H 27/40; D21H 27/002; D21H 27/02; D21H 27/32; B31F 1/07; B31F 2201/0715; D21F 11/006; D21F 11/14
See application file for complete search history.

(56) References Cited

U.S. PATENT DOCUMENTS

D65,879 S 10/1924 Vandergaw et al.
D66,160 S 12/1924 Vandergaw et al.
(Continued)

FOREIGN PATENT DOCUMENTS

EP 523382 B1 9/1996
EP 1160378 B1 2/2014
(Continued)

OTHER PUBLICATIONS

English-Language Abstract of JP200268535A, published Nov. 19, 2009.
(Continued)

*Primary Examiner* — Eric Hug
*Assistant Examiner* — Matthew M Eslami
(74) *Attorney, Agent, or Firm* — Finnegan, Henderson, Farabow, Garrett & Dunner LLP

(57) ABSTRACT

Products having reducing tissue wrinkling, puckering, and bunching and improved emboss definition, emboss visibility, and perceived softness are described. The methods comprise embossing the tissue sheet with a emboss elements having segments aligned in the machine direction and including an abatement component, such as a tapered width or a multi dual-apex, that can absorb machine direction stretch during the production of the product.

21 Claims, 8 Drawing Sheets

(51) Int. Cl.

| | |
|---|---|
| ***D21H 27/02*** | (2006.01) |
| ***D21F 11/00*** | (2006.01) |
| ***B31F 1/07*** | (2006.01) |
| ***D21H 27/32*** | (2006.01) |

(52) U.S. Cl.
CPC ..... *D21H 27/002* (2013.01); *D21H 27/02* (2013.01); *D21H 27/32* (2013.01); *B31F 2201/0715* (2013.01)

(56) References Cited

U.S. PATENT DOCUMENTS

| | | | | |
|---|---|---|---|---|
| 1,863,973 | A | 6/1932 | Ellis, Jr. | |
| D114,605 | S | 5/1939 | Turpan | |
| 2,177,490 | A | 10/1939 | Kieffer | |
| D117,997 | S | 12/1939 | Kaplan | |
| D129,008 | S | 8/1941 | Hafner | |
| 2,284,663 | A | 6/1942 | Kieffer | |
| D154,178 | S | 6/1949 | Ryan | |
| D157,619 | S | 3/1950 | Mitschke | |
| 4,000,242 | A | 12/1976 | Hartbauer | |
| 4,339,088 | A | 7/1982 | Niedermeyer | |
| D274,361 | S | 6/1984 | Whitehead | |
| 4,483,728 | A | 11/1984 | Bauemfeind | |
| 4,637,859 | A | 1/1987 | Trokhan | |
| 4,659,608 | A | 4/1987 | Schulz | |
| 5,093,068 | A | 3/1992 | Schulz | |
| 5,311,814 | A | 5/1994 | Kierson | |
| 5,505,818 | A | 4/1996 | Hermans | |
| 5,510,002 | A | 4/1996 | Hermans | |
| 5,573,830 | A | 11/1996 | Schulz | |
| 5,607,551 | A * | 3/1997 | Farrington, Jr. | B32B 29/00 162/109 |
| 5,672,248 | A | 9/1997 | Wendt | |
| D390,408 | S | 2/1998 | Kology et al. | |
| 6,017,417 | A | 1/2000 | Wendt | |
| D419,783 | S | 2/2000 | Tavenas | |
| 6,032,712 | A | 3/2000 | Biagiotti | |
| D424,359 | S | 5/2000 | Kology et al. | |
| D431,746 | S | 10/2000 | Pennington | |
| 6,235,373 | B1 | 5/2001 | Graff | |
| 6,245,414 | B1 | 6/2001 | Biagiotti | |
| 6,277,226 | B1 | 8/2001 | Schulz | |
| 6,395,133 | B1 | 5/2002 | McNeil | |
| D472,056 | S | 3/2003 | Jahner | |
| 6,585,855 | B2 | 7/2003 | Drew | |
| 6,599,614 | B1 | 7/2003 | Roussel et al. | |
| 6,610,173 | B1 | 8/2003 | Lindsay | |
| 6,805,766 | B1 | 10/2004 | Roussel et al. | |
| D502,004 | S | 2/2005 | Olson et al. | |
| D504,236 | S | 4/2005 | Olson et al. | |
| D505,551 | S | 5/2005 | Leisch | |
| 6,887,486 | B2 | 5/2005 | Gregoire | |
| D507,415 | S | 7/2005 | Boerschinger | |
| D527,909 | S | 9/2006 | Leisch | |
| D528,306 | S | 9/2006 | Leisch | |
| D529,295 | S | 10/2006 | Kressner et al. | |
| D540,093 | S | 4/2007 | Lan | |
| D581,677 | S | 12/2008 | Yeh | |
| 7,624,765 | B2 | 12/2009 | Burazin | |
| 7,829,177 | B2 | 11/2010 | Russell et al. | |
| D629,213 | S | 12/2010 | Carrier | |
| D634,129 | S | 3/2011 | Gerlach | |
| D636,607 | S | 4/2011 | Withers | |
| D660,011 | S | 5/2012 | Boerschinger | |
| D702,951 | S | 4/2014 | Timmerman | |
| D714,560 | S | 10/2014 | Xu et al. | |
| 8,859,844 | B2 | 10/2014 | Takeuchi et al. | |
| D719,742 | S | 12/2014 | Seitzinger | |
| 8,999,095 | B2 | 4/2015 | Sauter et al. | |
| 9,205,623 | B2 | 12/2015 | Barredo | |
| D751,825 | S | 3/2016 | Miller | |
| D756,033 | S | 5/2016 | Gordon et al. | |
| 9,416,496 | B2 | 8/2016 | Olson | |
| D765,425 | S | 9/2016 | Aragon | |
| D767,286 | S | 9/2016 | Newman et al. | |
| D773,834 | S | 12/2016 | Croteau | |
| D799,692 | S | 10/2017 | Buning-weddewer | |
| D823,608 | S | 7/2018 | Stephani et al. | |
| D860,656 | S | 9/2019 | Barai | |
| D864,589 | S | 10/2019 | Austin | |
| D865,402 | S | 11/2019 | Morrison et al. | |
| D871,082 | S | 12/2019 | Bradley et al. | |
| D879,505 | S | 3/2020 | Lopez | |
| D897,117 | S | 9/2020 | Gordon et al. | |
| D899,101 | S | 10/2020 | Freyre Marquez | |
| D911,752 | S | 3/2021 | Grant | |
| 2002/0079073 | A1 * | 6/2002 | Wilhelm | B31F 1/07 162/109 |
| 2003/0000664 | A1 | 1/2003 | Drew | |
| 2007/0082184 | A1 | 4/2007 | Hansson | |
| 2008/0301986 | A1 | 12/2008 | Quin | |
| 2009/0068409 | A1 | 3/2009 | Bret et al. | |
| 2009/0194244 | A1 | 8/2009 | Harper | |
| 2010/0021696 | A1 | 1/2010 | Hill et al. | |
| 2010/0038045 | A1 | 2/2010 | Pare et al. | |
| 2012/0088076 | A1 | 4/2012 | Glakpe et al. | |
| 2014/0141203 | A1 | 5/2014 | Sartini et al. | |
| 2015/0101772 | A1 | 4/2015 | Olson | |
| 2015/0176218 | A1 | 6/2015 | Maladen et al. | |
| 2015/0211187 | A1 | 7/2015 | Mcneil et al. | |
| 2018/0360288 | A1 | 12/2018 | Bradley et al. | |
| 2018/0363244 | A1 | 12/2018 | Sierra et al. | |
| 2019/0024321 | A1 * | 1/2019 | Schuh | B31F 1/07 |

FOREIGN PATENT DOCUMENTS

| | | | |
|---|---|---|---|
| GB | 2132141 | B | 12/1986 |
| JP | 200268535 | A | 11/2009 |
| JP | 2009268535 | A | 11/2009 |
| JP | 2013208297 | A | 10/2013 |
| WO | WO1996031652 | A1 | 10/1996 |
| WO | WO1998021410 | A1 | 5/1998 |
| WO | WO2010010580 | A2 | 1/2010 |
| WO | WO2010139759 | A1 | 12/2010 |

OTHER PUBLICATIONS

English-Language Abstract of JP2013208297A, published Oct. 10, 2013.

"To Emboss or Add Decals to Parts or Surfaces," Autodesk Knowledge Network, Feb. 2016. (https://knowledge.autodesk.com/support/inventor-products/learn-explore/caas/CloudHelp/cloudhelp/2016/EN/Inventor-Help/files/GUID-E6848555-B24-4858-8401-84E260771E84-htm.html).

Notice of Allowance received for U.S. Appl. No. 29/728,139, dated Oct. 18, 2021, 7 pages.

* cited by examiner

SOLID LINE EMBOSSMENT

DUEL APEX LINE EMBOSSMENT

SECTION A-A

SECTION B-B

TISSUE PRODUCTS HAVING EMBOSS ELEMENTS WITH REDUCED BUNCHING AND METHODS FOR PRODUCING THE SAME

CROSS REFERENCE TO RELATED APPLICATIONS

This application is based on U.S. Provisional Patent Application No. 62/990,152, filed Mar. 16, 2020. The priority of the foregoing application is hereby claimed and its disclosure incorporated herein by reference in its entirety.

The present disclosure relates to embossed tissue products and methods of making the same. More particularly, the present disclosure relates to embossed tissue products having reduced bunching or wrinkling. Still more particularly, the present disclosure relates to embossed tissue products with an emboss pattern of continuous, high aspect ratio, and/or machine direction elements with minimal bunching or wrinkling. Still more particularly, the present disclosure relates to embossed tissue products having continuous, high aspect ratio and/or machine direction emboss elements that include an abatement component, for example tapered or multi-apex segments, which minimize bunching or wrinkling of the embossed tissue sheet.

BACKGROUND

Consumers' daily lives are filled with a variety of modern products that are produced solely for their comfort and convenience. Absorbent paper goods take a prominent place in the list of the most used modern conveniences. Typical paper products used by consumers daily include, for example, toilet tissue, paper towel, napkins, wipers and the like.

In the current market where high-end absorbent paper products demand premium prices, consumers are very particular about the products for which they will pay a premium price. Premium products must be strong and absorbent, but also soft, and must be free from any visual defects. Consumer acceptance of premium absorbent paper products is heavily influenced by the perceived softness of the tissue product, including visual perception. Indeed, the consumer's perception of the desirability of one tissue product over another is often based in significant respects on the perceived relative softness of the tissue product; the tissue product that is perceived to be softest is typically perceived to be more acceptable.

Thus, tissue paper used in the production of premium commercial absorbent products should ideally possess a relatively high degree of perceived puffiness and softness. Product attributes are imparted to an absorbent product both during the production of the tissue sheet and during the converting operations that are used to change the tissue web into the final product.

During production, many parts of the process impact the softness, absorbency and the overall bulk of the sheet, but none more than the manner in which the sheet is dried. Drying of the web on a structured drying fabric without compaction results in the highest levels of bulk in the tissue sheet which translates to the greatest perceived softness. While these highly bulky sheets are preferred by consumers, their characteristics have created new issues that must be addressed to produce a successful premium product. By way of example, since the tissue base sheet is much bulkier than compactively dried tissue, these sheets result in larger tissue rolls that would not fit on consumer's standard toilet tissue holders. The industry moved to more tightly wound products, e.g., "two rolls in one," that would satisfy the consumer's desires.

Other characteristics of these tissue sheets have caused production methods to be modified to achieve highly desirable consumer products. One such characteristic, increased machine direction stretch, has created substantial limitations on the embossing of these tissue base sheets. During converting, emboss definition and final bulk of the tissue paper are commonly found to be key drivers in the perceived softness of the absorbent product. The typical tissue embossing process involves the compression and stretching of the flat tissue base sheet between either a relatively soft rubber roll and a hard roll which bears a pattern of emboss elements or between a pair of hard, often steel, rolls bearing matched emboss elements on each roll. These methods of embossing improve the structure and aesthetics of the tissue. However, due to the nature of embossing, patterns used on premium products are somewhat limited. To avoid visual defects like bunching and wrinkling, the patterns used in premium products have generally developed using smaller emboss elements and/or angular offsets.

Emboss patterns including elements aligned in the machine direction ("MD direction"), for example, are recognized to cause wrinkling, puckering, or bunching of the tissue between the elements, see, for example, U.S. Pat. No. 4,483,728. This is believed to be because elements aligned in the MD direction line up with the natural stretch of the paper base sheet. As described in the '728 patent, a continuous cross-hatch pattern, when aligned in the MD direction caused unacceptable puckering of the tissue sheet. To avoid bunching and puckering, the pattern was offset from the machine direction or was alternatively provided with "relieving spaces" in the elements, i.e., broken into smaller elements.

Another way to avoid bunching with patterns such as these is to run the process slow enough to prevent stretching of the paper base sheet; however, that has never been a commercial option. So, the primary commercial solutions to avoid bunching have been off-setting the pattern from the machine direction, and/or reducing the size of the emboss elements. While both solutions eliminate the visual defects, they significantly limit the choice of pattern that can be used on premium products.

Emboss patterns always affect the attributes of the final product to which they are applied. Generally embossing makes the tissue softer and bulkier, but embossing necessarily trades softness for strength. Balancing the softness improvements while minimizing the strength losses is an important characteristic in the area of premium tissue production. In many instances, the specific pattern is chosen to create certain balanced characteristics in the final product. For example, if the tissue web is rough, the emboss pattern may be chosen to create high softness. Likewise, if the product is a paper towel, the emboss pattern might be selected to minimize strength losses.

The selection of embossing patterns with continuous elements can be useful in creating desirable attributes in premium paper products. However, when applying a pattern having continuous emboss elements, both of the prior solutions fail.

With a pattern with continuous elements, alternative methods to prevent bunching are required, because to break the continuous elements into smaller elements would destroy the nature of the pattern. Likewise, offsetting the continuous pattern from the MD direction is possible; however, while there will be some improvement, there will still exist segments where the continuous emboss elements align in the MD direction and bunching is inevitable. Furthermore, when a machine direction pattern is specifically desired, off-set is not an option, and heretofore, the only other viable option has been to reduce the element size to reduce tension on the paper web.

Tissue bunching is further exacerbated when embossing high bulk sheets produced by newer tissue production methods. Through-air-drying has become the measured standard for the manufacture of premium grade tissues since it produces a tissue sheet having bulk, softness and absorbency. Because of the high energy demands of TAD, other structured tissue technologies have been developed. These technologies all use special fabrics or belts to impart a structure to the sheet but use significantly lower nip loads for dewatering than conventional wet pressing, for example, advanced tissue molding system "ATMOS" used by Voith, or energy efficient technologically advanced drying "eTAD", used by Georgia-Pacific. Many of the newer mills are moving to TAD or some variation for producing a structured tissue.

In addition to increased bulk, tissue produced using these methods also has a greater stretch. For example, structured tissue generally has an elongation in the MD direction of greater than about 10% compared to a tissue made using a compaction drying method. This high MD stretch when combined with an emboss element aligned in the MD direction can result in even greater bunching or waving issues. When an embossing element aligns in the MD direction, it lines up with the natural elongation of the sheet and causes extra stretch that can present in the form of a bunch or pucker. The tissue bunch can ride along the MD embossment until it either folds and sets into a wrinkle or until it hits an area where the additional stretched tissue can release and dissipate back into the sheet. Heretofore, this release occurred when there was a break between emboss elements.

The tissue products as described herein comprise emboss elements including an abatement component that can either absorb some of the added stretch or can dissipate the stretched tissue back into the sheet. The inclusion of an abatement component can reduce tissue bunching or wrinkling without the need to change look and feel of the emboss pattern, thereby opening up a myriad of patterns that either have continuous emboss elements or that have high aspect ratio elements aligned in the machine direction. In addition, the embossing methods as described can result in a tissue product having improved emboss definition and/or visibility and/or perceived softness.

SUMMARY OF THE DISCLOSURE

The present disclosure relates to a tissue product comprising at least one tissue ply comprising a pattern of embossments having at least one embossment comprising at least one segment aligned in the machine direction for a distance equal to an aspect ratio of at least 2.5, wherein the at least one embossment comprises an abatement component.

In one embodiment, the present disclosure relates to a tissue product comprising at least one tissue ply comprising a pattern of embossments having at least one embossment comprising at least one segment aligned in the machine direction for a distance equal to an aspect ratio of at least 2.5, wherein the at least one embossment comprises a varied width, for example, a tapered profile.

In one embodiment, the present disclosure relates to a tissue product comprising at least one tissue ply comprising a pattern of embossments, having at least one embossment comprising at least one segment aligned in the machine direction for a distance equal to an aspect ratio of at least 2.5, wherein the at least one embossment comprises a multi-dual-apex, for example, a dual-apex.

In some embodiments, the disclosure relates to a method for reducing the bunching or wrinkling of a tissue web comprising, embossing the web with a pattern of embossments having at least one embossment comprising at least one segment aligned in the machine direction for a distance equal to an aspect ratio of at least 2.5, wherein the at least one embossment comprises an abatement component.

According to yet another embodiment, the disclosure relates to a method of producing a multi-ply paper product comprising, forming a base sheet, embossing the base sheet with a pattern of embossments having at least one embossment comprising at least one segment aligned in the machine direction for a distance equal to an aspect ratio of at least 2.5, wherein the at least one embossment comprises an abatement component, and combining the embossed base sheet with at least one second base sheet by adhesive to form a multi-ply product.

According to yet another embodiment, the disclosure relates to an embossing method comprising, embossing a base sheet between a steel roll bearing a pattern and a rubber roll, wherein the pattern on the steel roll comprises a pattern of emboss elements having at least one emboss element comprising at least one segment aligned in the machine direction for a distance equal to an aspect ratio of at least 2.5, wherein the at least one embossment comprises an abatement component.

Additional advantages of the described methods and products will be set forth in part in the description which follows, and in part will be obvious from the description, or may be learned by practice of the disclosure. The advantages of the disclosure will be realized and attained by means of the elements and combinations particularly pointed out in the appended claims.

It is to be understood that both the foregoing general description and the following detailed description are exemplary and explanatory only and are not restrictive of the invention, as claimed. The accompanying drawings, which are incorporated in and constitute a part of this specification, illustrate several embodiments and together with the description, serve to explain the principles of the disclosure.

DETAILED DESCRIPTION

Figure 1A:
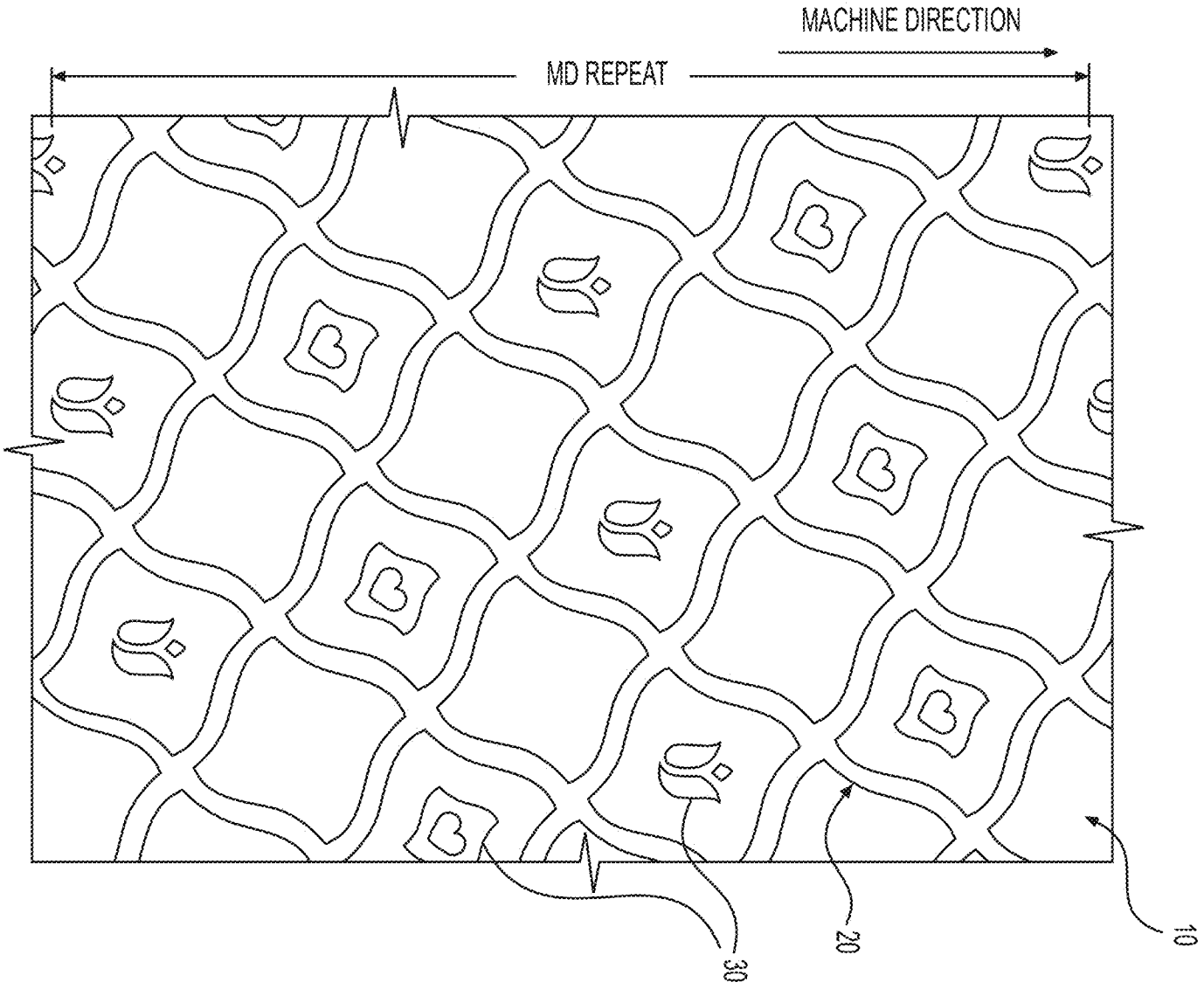
FIG. 1A illustrates an exemplary emboss pattern according to one embodiment of the disclosure including continuous embossment and signature embossments having conforming segments aligned in the MD direction.

Reference will now be made in detail to certain exemplary embodiments, examples of which are illustrated in the accompanying drawings. Wherever possible, the same reference numbers will be used throughout the drawings to refer to the same or like items.

Embossing with continuous elements and/or elements oriented in the machine direction provides improved pattern definition that can make the product more visually appealing to consumers of premium products. As described, a new technique has been discovered to prevent the wrinkling, bunching, or puckering of the paper during embossing with such elements. As used herein, the terms wrinkling, bunching, folding and puckering may be used interchangeably.

The present disclosure relates to a paper product having an emboss pattern having at least one embossment comprising at least one segment aligned in the machine direction for a distance equal to an aspect ratio of at least 2.5, wherein the at least one embossment comprises an abatement component. An abatement component is any design component that either reduces the web tension at the micro level allowing the web to reabsorb any stretching or that dissipates the stretched tissue back into the sheet during embossing of an emboss element having one or more segments oriented in the machine direction (MD). The emboss element is modified to improve its micro elasticity thereby either providing an area in which the bunch or pucker can be dissipated or providing a feature of the emboss elements that can absorb the stretch better thereby reducing the formation of a pucker or bunch in the stretched web.

In some embodiments, the abatement component comprises tapering of the emboss element segment aligned in the machine direction. In some embodiments, the tapered profile improves the emboss definition and visibility. In some embodiments, the tapered profile prevents bunching and/or puckering of the tissue sheet during embossing. In some embodiments, the tapered profile changes the optical characteristics making the paper web appear bulkier, and thereby perceived as softer.

In some embodiments, the abatement component comprises modifying the emboss element segment aligned in the machine direction to provide more surface area at the apex. The emboss element may be modified such that one or more channels are inserted down the center resulting in an element with a multi-apex. For example, the apex of the emboss element may be modified to insert a channel down the center resulting in an element such that it has a dual-apex. Without wishing to be bound by theory, it is believed that the channel(s) along the top of the emboss element allows the emboss element to absorb more of the MD direction stretch thereby reducing or preventing bunching or puckering. Abatement may occur when changes to the emboss element, such as a multi-apex, increase the surface areas of the emboss element, thereby providing more paper fiber available to absorb the increased stretch that is created when the embossing element has segments aligned in the MD direction.

The embossing technique as described can be used to produce tissue products from base sheets produced using conventional wet pressing, or the newer techniques for making premium grades tissues, as discussed infra. In conventional wet pressing, the nascent web is transferred to a papermaking felt and is dewatered by passing it between the felt and a press roll under pressure. The web is then pressed by a suction press roll against the surface of a rotating Yankee dryer cylinder that is heated to cause the paper to substantially dry on the cylinder surface. The moisture within the web as it is laid on the Yankee surface causes the web to transfer to the surface. Liquid adhesive may be applied to the surface of the dryer, as necessary, to provide substantial adherence of the web to the surface. The web is then removed from the Yankee surface with a creping blade. The creped web is then passed between calendar rollers and rolled up to be used as a base sheet in the downstream production of a tissue product. This method of making tissue sheets is commonly referred to as "wet-pressed" because of the compactive method used to dewater the wet web.

These processes all share the characteristic that the sheet is dewatered under pressure. While one conventional wet pressing operation is described above, the system is only exemplary and variations on the described system will be readily apparent to the skilled artisan.

In through-air-drying ("TAD") methods the nascent web is partially dewatered using vacuum suction. Thereafter, the partially dewatered web is dried without compression by passing hot air through the web while it is supported by a through-drying fabric. However, as compared to conventional wet pressing, through-air-drying is expensive in terms of capital and energy costs. Because of the consumer perceived softness of these products and their greater ability to absorb liquid than webs formed in conventional wet press processes, the products formed by the through-air-drying process enjoy an advantage in consumer acceptance. Because it does not suffer from compaction losses, through-air-dried tissue base sheets currently exhibits the highest caliper, i.e., bulk, of any base sheet for use in premium absorbent products.

Alternatives to TAD include processes that use special fabrics or belts to impart a structure to the sheet, but which continue to use some limited nip load. In connection with the production of structured sheets, fabric molding has also been employed as a means to provide texture and bulk. In this respect, there is seen in U.S. Pat. No. 6,610,173 to Lindsay et al. a method for imprinting a paper web during a wet pressing event which results in asymmetrical protrusions corresponding to the deflection conduits of a deflection member. The '173 patent reports that a differential velocity transfer during a pressing event serves to improve the molding and imprinting of a web with a deflection member.

The tissue webs produced are reported as having particular sets of physical and geometrical properties, such as a pattern densified network and a repeating pattern of protrusions having asymmetrical structures. With respect to wet-molding of a web using textured fabrics, see, also, the following: U.S. Pat. Nos. 6,017,417 and 5,672,248 both to Wendt et al.; U.S. Pat. Nos. 5,505,818 and 5,510,002 to Hermans et al. and U.S. Pat. No. 4,637,859 to Trokhan. With respect to the use of fabrics used to impart texture to a mostly dry sheet, see U.S. Pat. No. 6,585,855 to Drew et al., as well as United States Publication No. US 2003/0000664 A1.

As used herein "structured tissues" or "structured webs" refer to tissue made by TAD or other structured tissue technologies. These processes all share the characteristic that the sheet is dewatered under limited or no compaction. While one through-air-drying operation is described above, the system is only exemplary and variations on the described system will be readily apparent to the skilled artisan.

As used herein "web," "sheet," "tissue," "nascent web," "tissue product," "base sheet" or "tissue sheet," can be used interchangeably to refer to the fibrous web during various stages of its development. Nascent web, for example, refers to the embryonic web that is deposited on the forming wire. Once the web achieves about 30% solids content, it is referred to as a tissue, or a sheet or a web. Post production, the single-ply of tissue is called a base sheet. The base sheet may be combined with other base sheets to form a tissue product or a multi-ply product.

The base sheet for use in the products of the present disclosure may be made from any art recognized fibers. Papermaking fibers used to form the absorbent products of the present disclosure include cellulosic fibers, commonly referred to as wood fibers. Specifically, the base sheet of the disclosure can be produced from hardwood (angiosperms or deciduous trees) or softwood (gymnosperms or coniferous trees) fibers, and any combination thereof. Hardwood fibers include, but are not limited to maple, birch, aspen and eucalyptus. Hardwood fibers generally have a fiber length of about 2.0 mm or less. Softwood fibers include, but are not limited to, spruce and pine. Softwood fibers exhibit an average fiber length of about 2.5 mm. Cellulosic fibers from diverse material origins may also be used to form the web of the present disclosure. The web of the present disclosure may also include recycle or secondary fiber. The products of the present disclosure can also include synthetic fibers as desired for the end product.

Papermaking fibers can be liberated from their source material by any one of a number of chemical pulping processes familiar to one experienced in the art including sulfate, sulfite, polysulfite, soda pulping, etc. The pulp can be bleached as desired by chemical means including the use of chlorine, chlorine dioxide, oxygen, etc. Alternatively, the papermaking fibers can be liberated from source material by any one of a number of mechanical/chemical pulping processes familiar to anyone experienced in the art including mechanical pulping, thermomechanical pulping, and chemithermomechanical pulping. These mechanical pulps can be bleached, if one wishes, by a number of familiar bleaching schemes including alkaline peroxide and ozone bleaching.

In a typical process, the fiber is fed into a headbox where it will be admixed with water and chemical additives, as appropriate, before being deposited on the forming wire. The chemical additives for use in the formation of the base sheets can be any known combination of papermaking chemicals. Such chemistry is readily understood by the skilled artisan and its selection will depend upon the type of end product that one is making. Papermaking chemicals include, for example, one or more of strength agents, softeners and debonders, creping modifiers, sizing agents, optical brightening agents, retention agents, and the like. The method used in the instant disclosure to reduce fiber bunching should not generally be affected by the chemistry of the base sheet.

While exemplary formation of the base sheet is detailed above, products using any base sheet can benefit from being embossed with a pattern as described herein. The base sheet for use in the present disclosure can include base sheets that are creped or uncreped, homogeneous or stratified, wet-laid or air-laid and may contain up to 100% non-cellulose fibers.

In a typical process, the base sheet is rolled and awaits converting. Converting refers to the process that changes or converts base sheets into final products. Typical converting in the area of tissue and towel includes embossing, perforating, gluing, and/or plying.

Unless indicated otherwise, as used herein, "an emboss, (the noun)", "embossing element," "embossment," "boss," are all used interchangeably and refer to an element within an embossing pattern that causes the base sheet to form protrusions or recessions in the paper sheet, or to the protrusions or recessions in the sheet themselves.

Figure 5:
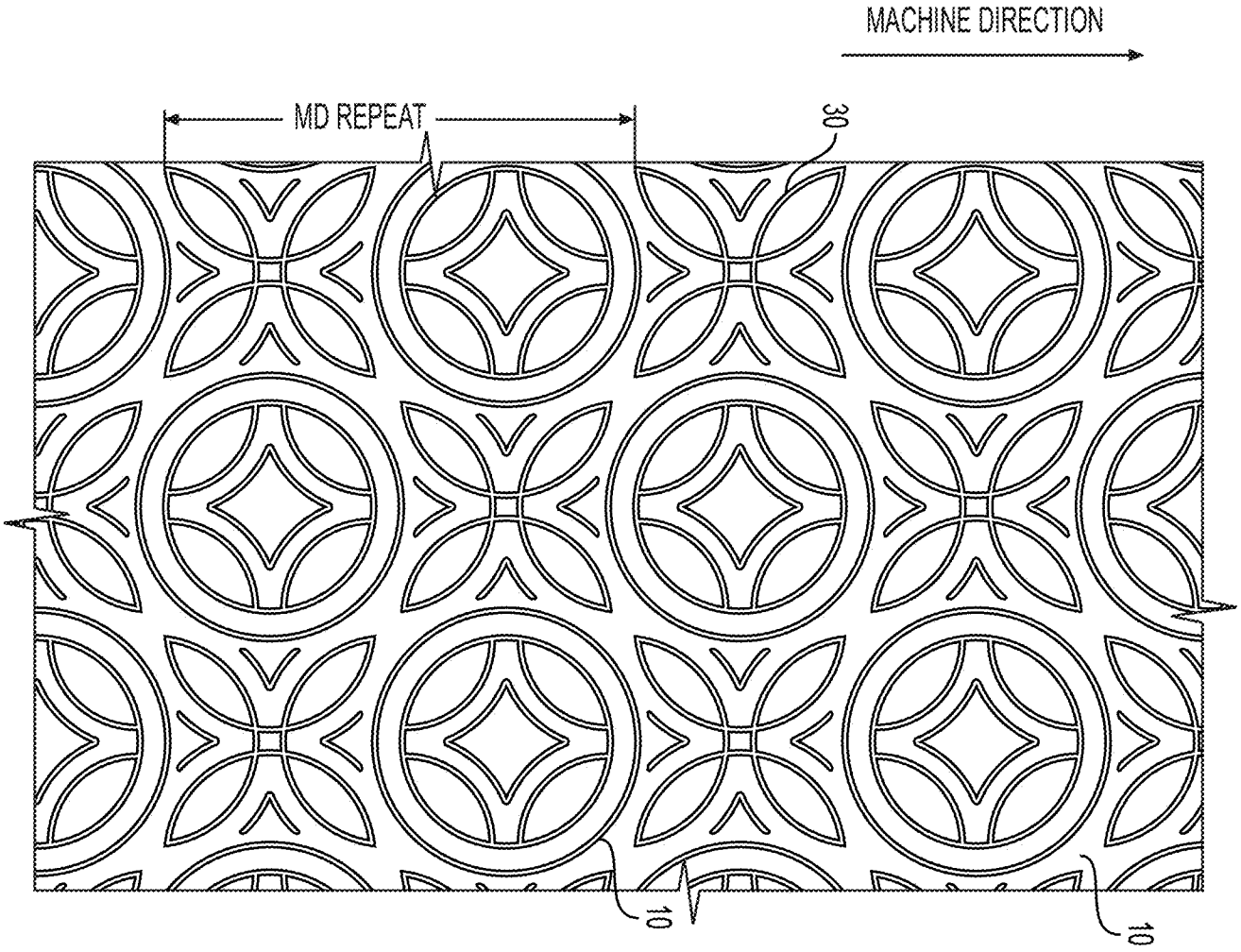
FIG. 5 illustrates an exemplary emboss pattern according to a second embodiment of the disclosure including continuous embossment and signature embossments having conforming segments aligned in the MD direction.
Figure 6:
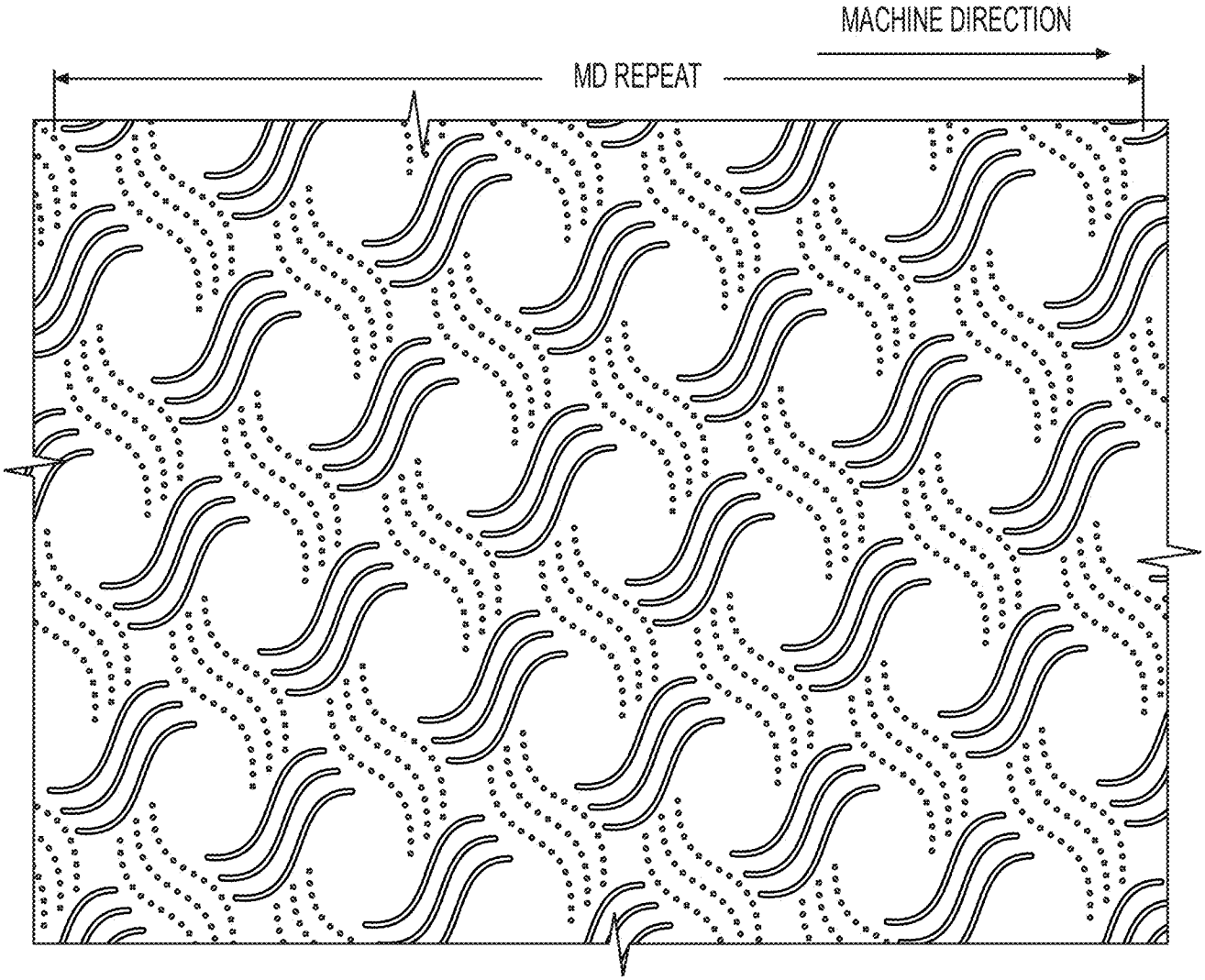
FIG. 6 illustrates an exemplary emboss pattern according to a third embodiment of the disclosure including high aspect ratio embossments having conforming segment aligned in the MD direction.

Embossing patterns of the instant disclosure are made up of elements that are arranged to create a design. The particular pattern may be chosen based on a myriad of considerations, including those that are functional as well as those that are non-functional aesthetic and ornamental, for example the patterns shown in FIGS. 1A, 5, and 6. The exemplary patterns disclosed herein are not limiting and are not the only patterns that will exhibit the claimed utility. For rolled products, the pattern would generally traverse the entire width and length of the base sheet. Emboss patterns for use in the instant disclosure may be an indication of source of the goods, or may contain one or more design elements that are trademarks, source identifiers, or decorative elements referred to herein as a signature embosses. In FIG. 1A, signature emboss elements are shown as hearts and flowers. In some embodiments, the embossing patterns of the instant disclosure may contain one or more continuous elements. As used herein "continuous element" refers to an element that is a closed loop. The loop may be any shape or design. In FIG. 1A, continuous emboss elements are shown as wavy diamonds.

The embossing patterns of the instant invention have one or more embossment comprising at least one segment aligned in the machine direction of the sheet (the direction the sheet travels in the papermaking machine during formation and processing). In some embodiments, the patterns can include embossments or segments of embossments that are not offset from the machine direction, but which are square with the paper web, i.e., at a 90° angle to the paper's edge. In some embodiments, the patterns can include embossments that are offset from the machine direction or other varied patterns, so long as they contain segments that periodically align in the MD direction of the sheet. Such patterns can include continuous patterns or patterns having a series of high aspect ratio elements. High aspect ratio elements refer to elements that have an aspect ratio of 5 or greater. As used herein "aspect ratio" refers to the size of an element based upon a ratio of its length to its width. For example, an embossing element with an aspect ratio of 2.5 would be twice as long as it is wide.

While the description of the pattern has been generalized, this invention can be used with any emboss pattern that suffers from bunching or puckering due to the presence of one or more emboss elements having segments that align in the MD direction.

As used herein a "conforming element" refers to an emboss element having at least one segment that aligns with the machine direction of the sheet for a distance equal to an aspect ratio of at least 2.5. "A distance equal to an aspect ratio of at least 2.5" means that, for any conforming element, the length of the segment that aligns in the MD direction is at least 2.5 times the width of that segment of the embossing element.

Figure 1B:
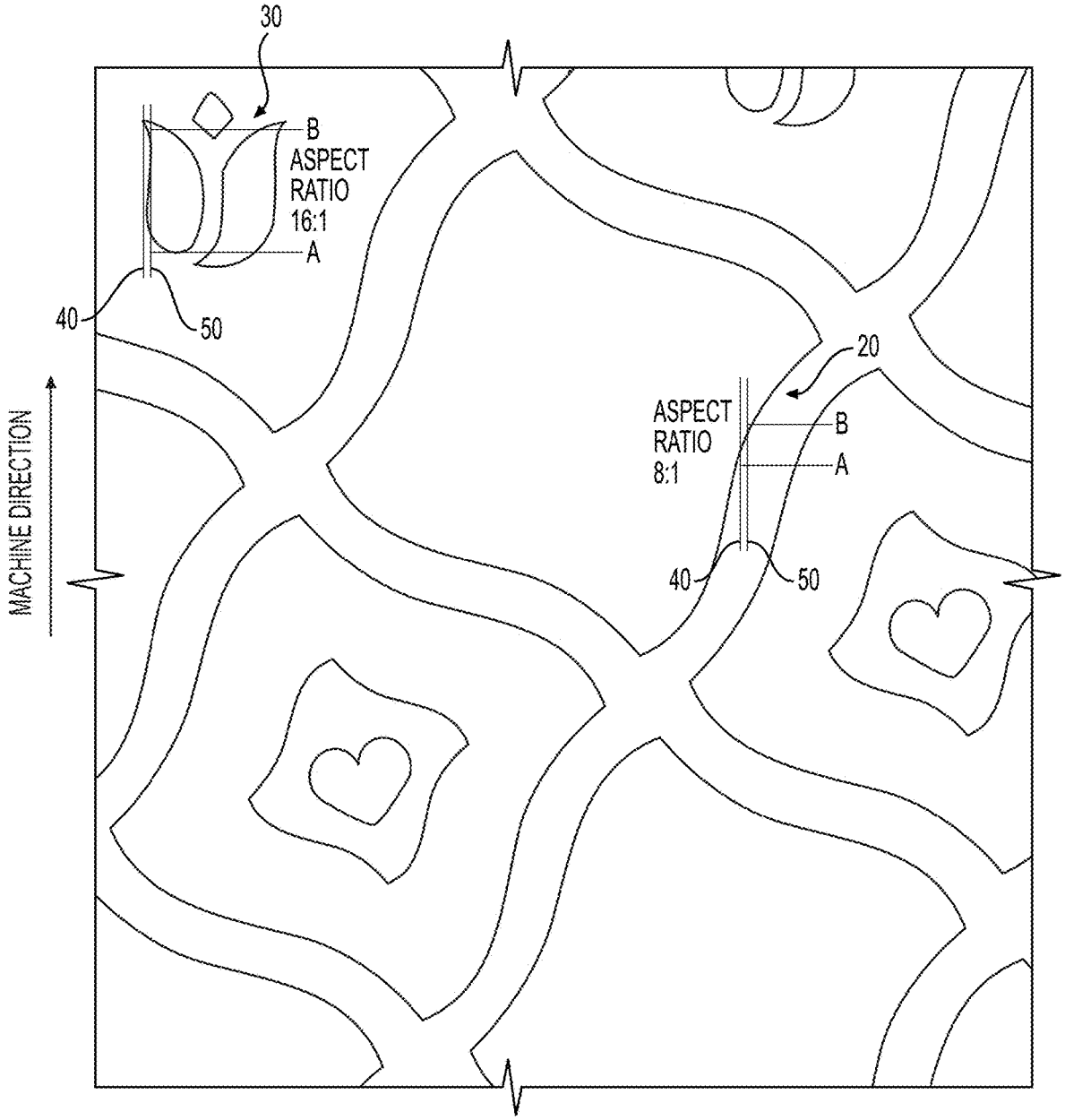
FIG. 1B illustrates how to measure the aspect ratio of a conforming segment aligned in the MD direction of each of a continuous embossment and a signature embossment from the pattern of FIG. 1A.

The method for determining whether an element of a continuous embossment or of a signature embossment is a conforming element is set forth in FIG. 1B. As seen in FIG. 1B, first, a set of parallel lines 40 and 50 are drawn in the machine direction spaced apart by a distance equal to the width of a segment of the emboss element. If the length of the emboss element segment inside one pair of lines exceeds at least 2.5 times the width, then the segment of the emboss element is considered to align in the machine direction and the emboss element is considered to be a conforming element. If the element has varied widths, the average width of the segment at issue, as a function of area, would be used. As seen in FIG. 1B, the distance is calculated from the point at which the element moves into the line pair, e.g., point A, and stops when the element crosses back over the line and out of the machine direction, at point B.

As used herein "conforming element," "an embossing element that aligns in the MD direction," and "an MD direction embossing element" are used interchangeably and refer to an emboss element comprising at least one segment aligned in the machine direction for a distance equal to an aspect ratio of at least 2.5 as measured by the process in the preceding paragraph (referred to herein as a "conforming segment").

When elements are embossed into a base sheet, tensions are placed on the fibers to move them into new positions. When an embossing element aligns in the MD direction, it lines up with the natural elongation of the sheet. As the fiber moves forward and accumulates, a natural pucker or bunch will form and can present in the form of a bunch, pucker, fold or wrinkle unless the extra fiber is abated and absorbed back into the sheet. This phenomenon occurs, in part, because the web is already tensioned in the MD direction, the MD direction being the direction the sheet travels. In addition, when embossing is carried out using a standard rubber backing roll, the pressures applied to conform the rubber to the pattern of elements also contributes to the stretch of the fibers.

This extra stretch that causes puckers and bunches can get more pronounced with increasing length of the emboss elements. In some embodiments, the products are made from base sheets having a MD elongation (stretch) of at least about 10%, for example, at least about 12%, for example, at least about 14%, for example, for at least about 17%, for example, from about 10% to about 40%, for example, from about 10% to about 27%.

In some embodiments, the emboss pattern comprises at least one embossment having at least one segment aligned in the machine direction for a distance equal to an aspect ratio of at least 2.5, for example for a distance equal to an aspect ratio of at least about 3, a distance equal to an aspect ratio of at least about 5, a distance equal to an aspect ratio of at least about 8, a distance equal to an aspect ratio of at least about 10, or a distance equal to an aspect ratio of at least about 15.

According to the present invention, the at least one conforming segment aligned in the machine direction comprises an abatement component. "Abatement component" refers to a modification made to the conforming segment for the purpose of minimizing wrinkling, bunching, or puckering. The abatement component can take multiple shapes, including a taper that varies the width of the element along the conforming segment, or a multi-apex, such as a dual-apex.

The products as described herein will be discussed with respect to the embodiment depicted; however, other products and product types can avail themselves of the advantages associated with the methods and embossments described.

When embossing with a pattern comprising continuous emboss elements, as seen, for example, in FIG. 1A, the overall pattern can be off-set from the machine direction and still have significant segments of the continuous emboss elements that align in the MD direction. When this happens, sections of the tissue web are left with puckers and bunches. These result in an unattractive product, which would not be commercially viable as a premium product in the current market.

FIG. 1A depicts a pattern 10 comprised of continuous emboss elements 20 and signature elements 30. In the embodiment shown, both the continuous emboss elements 20 and the signature elements 30 are conforming elements since segments of the elements align in the machine direction for an aspect ratio of at least 2.5, as seen in FIG. 1B. As seen in FIG. 1A, the pattern 10 is offset from the machine direction; however, due to the conforming nature of the embossing elements, this off-set fails to prevent bunching of the web around the continuous emboss elements 20. The use of an abatement component as described herein resolved the bunching and pucker problem without breaking the pattern up into smaller embossments. Further, with an abatement component, signature elements 30 that naturally align in the MD direction do not need to be offset to prevent bunch or puckering around the elements.

Figure 2A:
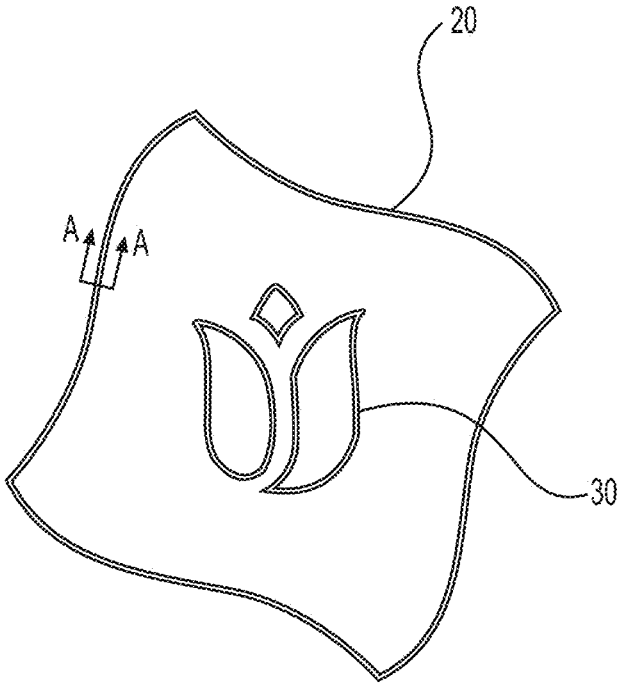
FIG. 2A illustrates an enlarged single lattice element from the pattern of FIG. 1A with a dual-apex configuration.
Figure 2B:
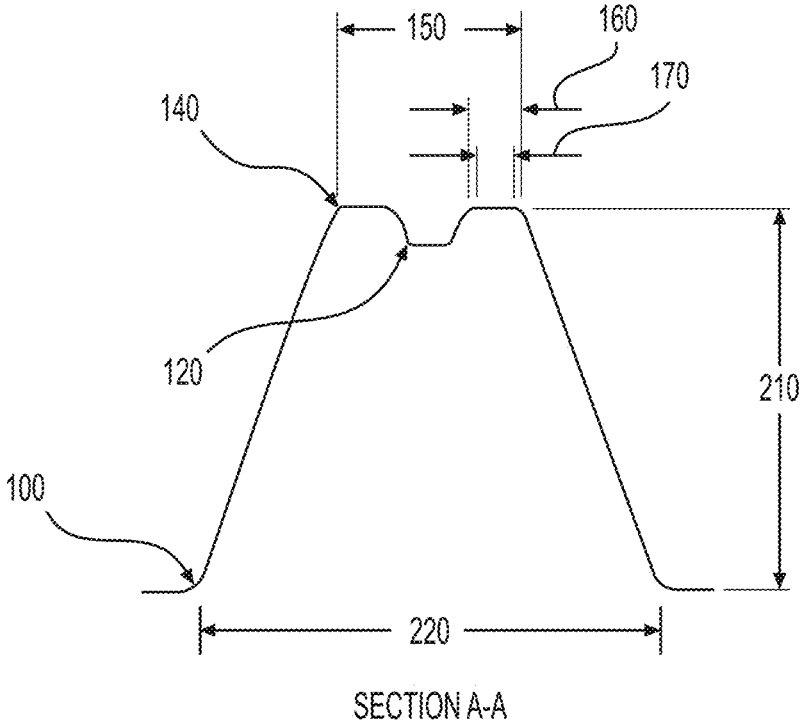
FIG. 2B illustrates an enlarged cross section of the emboss element at line A-A of FIG. 2A with a dual-apex configuration.

According to the embodiment seen in FIGS. 1A to 2B, the continuous emboss elements were altered to modify the apex of the elements. FIG. 2A is an enlarged view of a signature element 30 and a continuous emboss element 20 as seen in the pattern of FIG. 1A. FIG. 2B is the cross section of the continuous emboss element 20 at line A-A as seen in FIG. 2A. The continuous emboss element in FIG. 2B has a base 100 of width 220 (also referred to as the "base dimension"), a height 210, and an apex 140. The apex 140 includes a channel 120 that divides the apex into two sections, each having a width 160 and a contact area 170. The width of the two sections, plus the channel 120 make up the entire width 150 of the apex 140 (also referred to as the "apex dimension"). The change to include the channel 120 in the top of the continuous emboss elements 20 according to the present invention provide sufficient tension release to abate the formation of the puckers and bunches. As will be readily apparent to the skilled artisan after reading this disclosure, the changes to the element apex can take a variety of shapes or number of apex, so long as the element includes sufficient micro elasticity to mitigate the extra stretch that occurs when the elements line up in the MD direction.

Figure 2C:
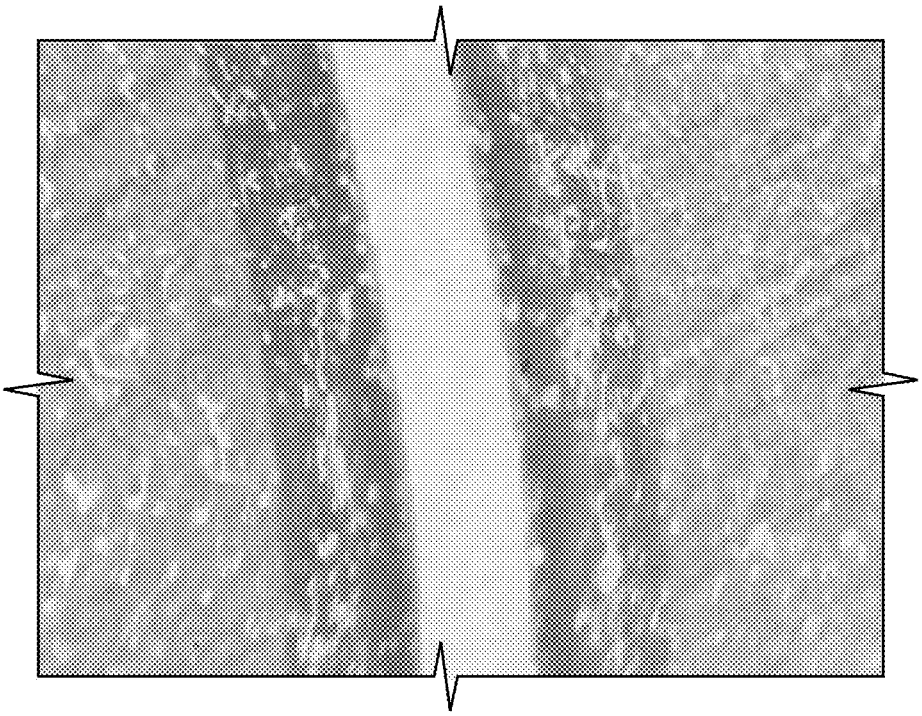
FIG. 2C is a top view perspective of a traditional solid line embossment with only a single apex according to the prior art.
Figure 2D:
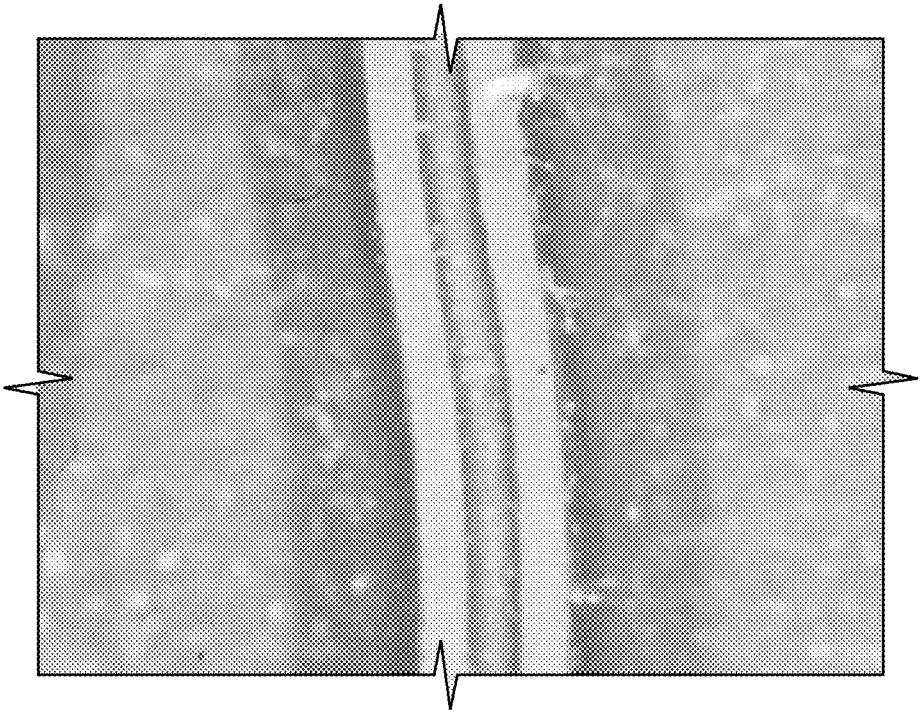
FIG. 2D is a top view perspective of an exemplary dual-apex line embossment according to FIG. 2B.

FIG. 2C is a top view perspective of a traditional solid line embossment with only a single apex according to the prior art. FIG. 2D is a top view perspective of an exemplary dual-apex line embossment according to FIG. 2B.

Figure 3A:
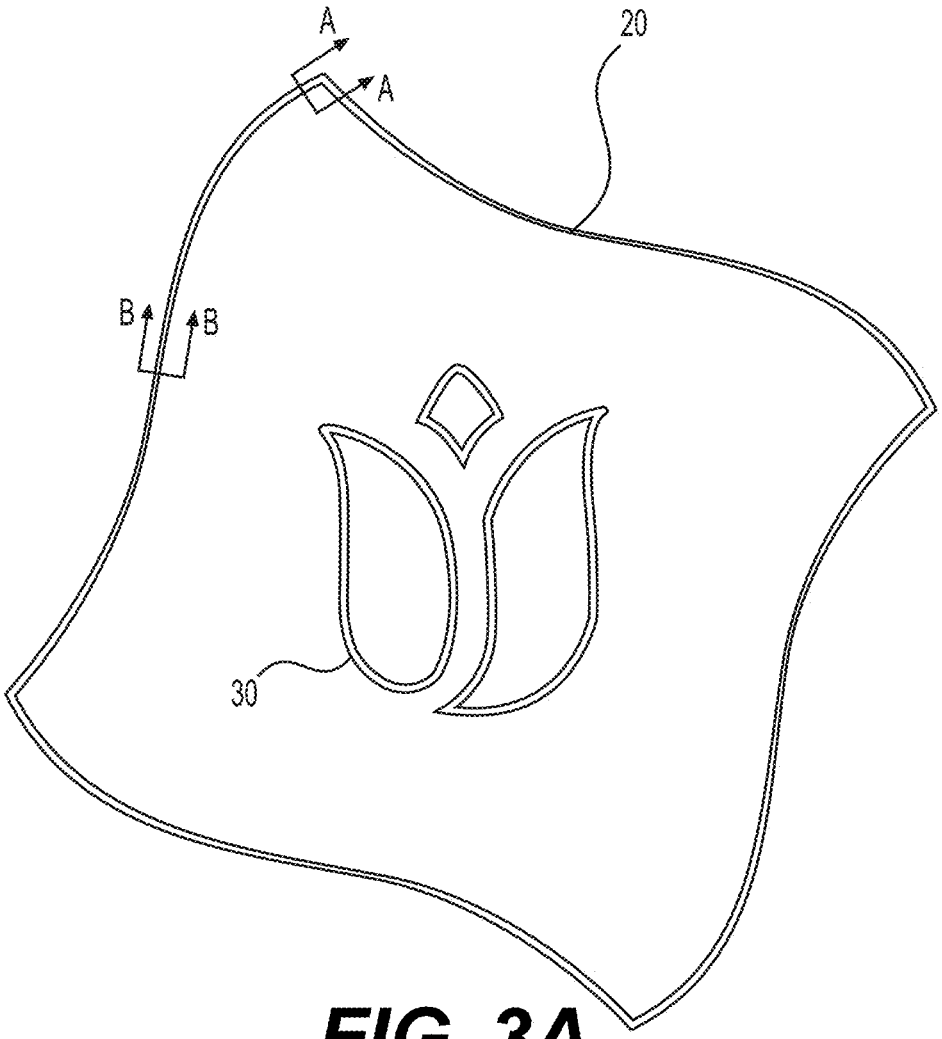
FIG. 3A illustrates an enlarged single lattice element of FIG. 1A with a tapered configuration, wherein the continuous embossment has a width that widens towards the corners and narrows towards the center of the sides of the embossment.

FIG. 3A depicts another embodiment in which the pattern of FIG. 1A may comprise an abatement component to minimize bunching. In this embodiment, the continuous emboss elements 20 are tapered such that they absorb the extra stretch and thereby prevent bunching or puckering during embossing. As seen in FIG. 3A, if a cross section of the continuous embossment were taken at both A-A and B-B, the width of the embossment would be greater at A-A than at B-B.

Figure 3B:
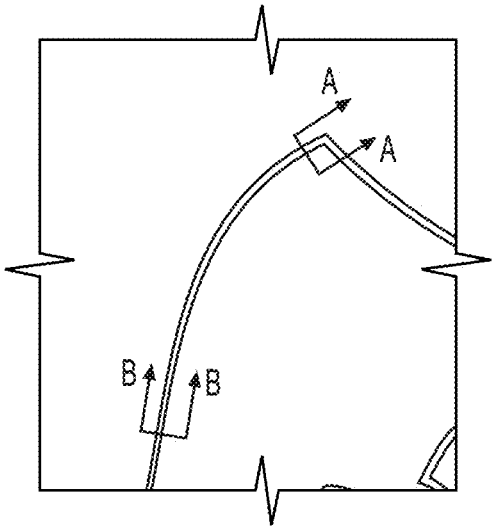
FIG. 3B illustrates an enlarged perspective of the upper left quadrant of the single lattice element of FIG. 3A, showing the embossment width at line B-B widening as it reaches A-A.
Figure 4A:
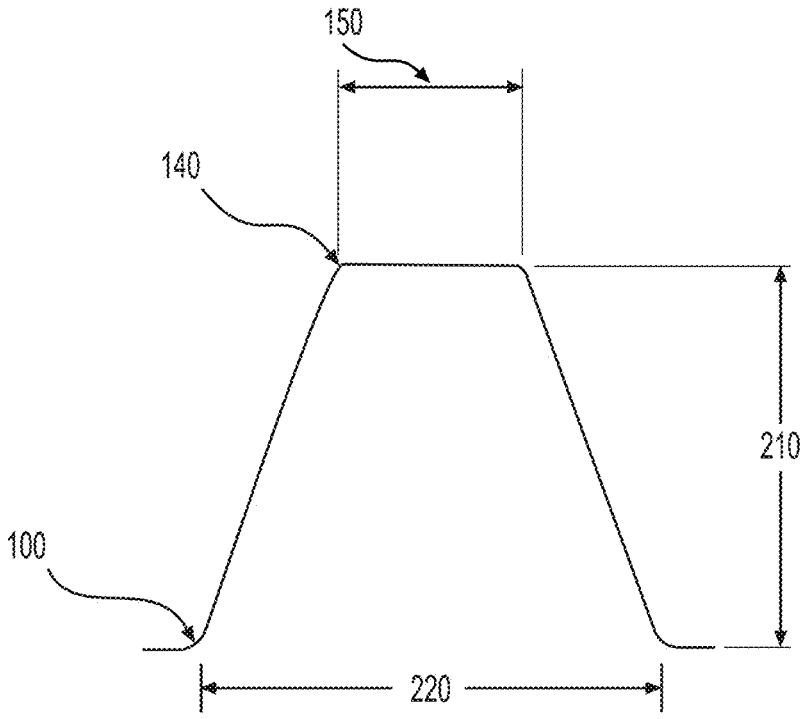
FIG. 4A illustrates an enlarged cross section of the emboss element at line A-A in FIG. 3B.
Figure 4B:
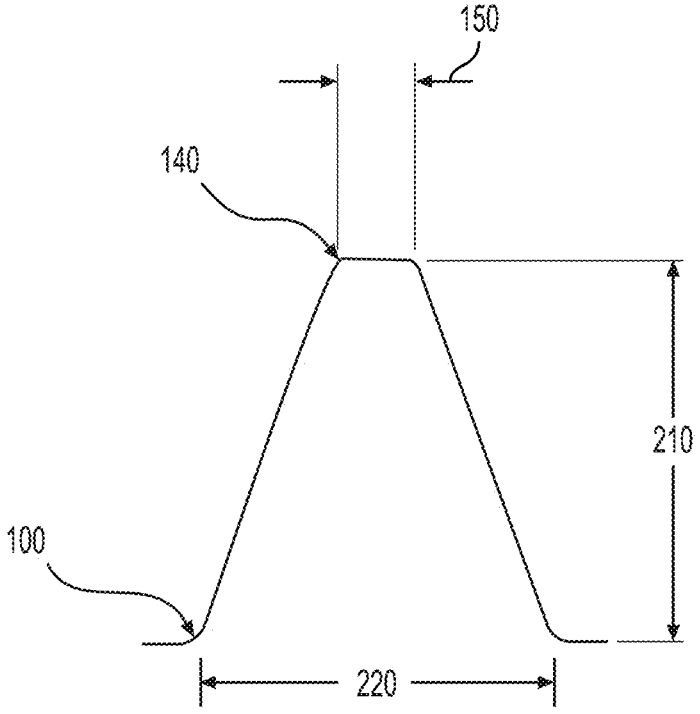
FIG. 4B illustrates an enlarged cross section of the emboss element at line B-B in FIG. 3B.

This may also be seen in FIG. 3B (which illustrates an enlarged perspective of the upper left quadrant of the single lattice element of FIG. 3A), in FIG. 4A (which illustrates an enlarged cross section of the emboss element at line A-A in FIG. 3B), and in FIG. 4B (which illustrates an enlarged cross section of the emboss element at line B-B in FIG. 3B).

In FIGS. 4A and 4B, each of the cross sections has a base 100 of width 220 (also referred to as the "base dimension"), a height 210, and an apex 140. The apex 140 has a width 150 (also referred to as the "apex dimension"). As can be seen in the FIGS. 4A and 4B, the section B-B has a narrower base dimension 220 and a narrower apex dimension 150 than the base 220 and apex 150 dimensions of section A-A, resulting in a tapered profile on the emboss element. As defined herein, taper refers to a fluctuation in width of the emboss element measured along the apex of the emboss element. According to the embodiment, as seen in FIG. 3B, the continuous emboss element 20 is wider at the corners of the element, line A-A, and becomes narrower at the middle portions, line B-B.

Without wishing to be bound by theory, it is believed that when a taper is included in a continuous or high aspect ratio emboss element, the taper provides additional surface area in the sheet to absorb the increased stretch created in the machine direction. Continuous and high aspect ratio emboss elements can have one or more tapers depending upon their length and MD alignment. For example, if a continuous element is offset from the machine direction, as are the continuous emboss elements 20 of FIG. 3A, the extent of MD alignment is lower than say, the same pattern fully aligned in the MD direction. While a single taper may abate the stretch in the continuous emboss element 20 of FIG. 3A, the same pattern fully aligned in the MD direction may require more than one taper along its length to sufficiently prevent bunching and puckering.

The characteristics of the taper along the element, e.g., length of the tapered segment, reduction in width of the element apex, and the need for more than one taper segment along the element are generally dictated by the pattern that is chosen and the nature of the sheet that is being embossed. The longer the emboss elements, the greater the MD alignment, and the more stretch the sheet has, the higher the amount of fiber that will get carried in the machine direction during embossing and the more abatement will be required to absorb that fiber back into the sheet without bunching or puckering around the pattern.

In some embodiments, the conforming embossing element has a single taper. In some embodiments, the conforming embossing element has multiple tapers spaced over an interval along the length of the element. In some embodiments, the taper occurs at an interval of at least about 2.5, for example, at least about 3, for example, at least about 5, or at least about 10. "Interval" is used herein to refer to a position on a given embossing element. For a high aspect ratio element or a continuous element, interval is used to denote position within the element. So, for example, a continuous element may have an abatement component at an interval of 5, meaning at every interval of 5. The interval refers to the aspect ratio used to calculate the length component. So, an interval of 5 for an embossing element that is 0.01" wide means the abatement component is placed at every 0.05" along the length of the element.

In some embodiments, the conforming elements have an aspect ratio (ratio of the length of the emboss element to the average width of the base of the emboss element) of from about 2.5 to about 50, for example, from about 2.5 to about 40, for example, from about 2.5 to about 25, for example, from about 2.5 to continuous.

In some embodiments, the emboss elements have an average width at the base of the emboss element of from about 0.05 inches to about 0.09 inches, for example from about 0.06 inches to about 0.09 inches, for example, from about 0.065 inches to about 0.085 inches. In some embodiments, where the conforming elements have tapered widths, the width of the base of the emboss element varies from a narrowest portion to a widest portion. In such embodiments, the narrowest portion of the taper may be at least about 5% less than the width of the base at the widest portion, for example, at least about 10%, at least about 15%, or at least about 25%.

In some embodiments, the elements have an average width at the apex of the emboss element of from about 0.01 inches to about 0.08 inches, for example, from about 0.01 to about 0.04 inches, for example, from about 0.015 to about 0.025 inches. In some embodiments, where the conforming elements have tapered widths, the width of the apex of the emboss element varies from a narrowest portion to a widest portion. In such embodiments, the narrowest portion of the taper may be at least about 5% less than the width of the apex at the widest portion, for example, at least about 10%, at least about 15%, or at least about 25%.

In some embodiments, the width of the at least one channel 120 at the top of the element comprises at least about 10% of the total width 150 of the apex 140, for example, at least about 20%, at least about 35% or at least about 50%. In some embodiments, the width of the at least one channel 120 at the top of the element comprises from about 20% to about 50% of the total width 150 of the apex 140.

In some embodiments, the angle of the sidewalls of the conforming emboss elements is between about 10 and about 30 degrees, for example, between about 13 and 25 degrees, for example, about 15 to about 20 degrees, for example, about 20 degrees. When embossing with a rubber backing roll, the higher the angle of the sidewall, the more rubber the element contacts thereby causing more stretch and exacerbating the bunching issue.

In some embodiments, the conforming embossing elements are embossed to a depth of from 0.050 to about 0.075 inches, for example, to a depth of about 0.055 to about 0.070 inches.

In some embodiments the conforming emboss depth is from about 0.05 inches to about 0.09 inches, for example, from about 0.06 inches to about 0.07 inches.

When the skilled artisan is selecting the appropriate abatement component for the desired pattern, three characteristics generally impact the need for abatement and what type of abatement should be selected. The first is length of the embossing element. The industry typically prevents puckers and bunching by keeping the emboss elements small, e.g., having an aspect ratio of about 2. The break between the elements creates a natural abatement for the extra fiber. However, if high aspect ratio embossing elements are used, the longer the element, the greater the likelihood of bunching. The longer the embossing element, the more time the fiber has to accumulate along the element.

The second characteristic is the orientation of the element. The greater the machine direction alignment of the embossing elements or pattern, the more likely the pattern will cause bunching and puckering. Fiber accumulation is exacerbated when the emboss element aligns with the MD stretch of the paper. The greater the MD alignment, the more fiber gets carried along with the emboss element and the more likely the sheet will bunch or pucker.

Finally, sheet characteristics plays a significant role in bunching and puckering. The more stretch the sheet has, the more fiber that will be moved in the MD direction. The thicker the sheet or the higher the basis weight, the more fiber there is to rearrange and therefore carry along.

These three characteristics are interdependent. The closer the pattern is to machine direction, the shorter the element must be to prevent puckering and bunching. Commercial patterns generally have an aspect ratio of 2 or less if they are aligned in the machine direction. As the pattern orientation moves from the MD direction to the CD direction, the longer the element can be without causing substantial bunching and puckering. In addition, the lower the stretch, the longer the MD direction elements can be without causing significant bunching.

Unless otherwise specified, "basis weight", "BWT," "BW," and so forth, refers to the weight (lbs) of a 3000 square-foot ream of product (basis weight may also be expressed in g/m$^2$ or gsm). Likewise, "ream" means a 3000 square-foot ream, unless otherwise specified. TAPPI LAB-CONDITIONS refers to TAPPI T-402 test methods specifying time, temperature and humidity conditions for a sequence of conditioning steps. The product of the present disclosure has a single base sheet basis weight of from about 7 to about 35 lbs/ream. In some embodiments, the product has a basis weight of from about 9 to about 18 lbs/ream, for example, from about 9 to about 15 lbs/ream, for example, from about 10 to about 14 lbs/ream, for example from about 11 to about 13 lbs/ream.

The product of the present disclosure has a caliper of from at least about 80 mils/8 sheets to about 300 mils/8 sheets, for example, from about 100 mils/8 sheets to about 250 mils/8 sheets, for example, from about 80 mils/8 sheets to about 200 mils/8 sheets, for example, 100 mils/8 sheets to about 160 mils/8 sheets, for example, 110 mils/8 sheets to about 150 mils/8 sheets.

Calipers reported herein are 8-sheet calipers unless otherwise indicated. The sheets are stacked and the caliper measurement taken about the central portion of the stack. Preferably, the test samples are conditioned in an atmosphere of 23°±1.0° C. (73.4°±1.8° F.) at 50% relative humidity for at least about 2 hours and then measured with a Thwing-Albert Model 89-II-JR or Progage Electronic Thickness Tester with 2-in (50.8-mm) diameter anvils, 539±10 grams dead weight load, and 0.231 in./sec descent rate. For finished product testing, each sheet of product to be tested must have the same number of plies as the product is sold. For base sheet testing off of the paper machine reel, single plies are used with eight sheets being selected and stacked together. Specific volume is determined from basis weight and caliper.

Dry tensile strengths (MD and CD), stretch, ratios thereof, break modulus, stress and strain are measured with a standard Instron test device or other suitable elongation tensile tester which may be configured in various ways, typically using 3 or 1 inch wide strips of tissue or towel, conditioned at 50% relative humidity and 23° C. (73.4° F.), with the tensile test run at a crosshead speed of 2 in/min. Break modulus is the ratio of peak load to stretch at peak load.

GMT refers to the geometric mean tensile strength of the CD and MD tensile. Tensile energy absorption (TEA) is measured in accordance with TAPPI test method T581 om-17. The product of the present disclosure has a Geometric Mean Tensile Strength (GMT) of from about 400 to about 4500, for example 600 to about 3500, for example, from about 700 to about 3200, for example, from about 700 to about 2500, for example, from about 750 to about 2500, for example, from about 750 to about 1200, for example, from about 825 to 875.

In some embodiments, the products are made from base sheets having a MD elongation (stretch) of at least about 10%, for example, at least about 12%, for example, at least about 14%, for example, for at least about 17%, for example, from about 10% to about 40%, for example, from about 15% to about 30%.

In some embodiments, base sheets are dried and rolled and subsequently embossed to provide an emboss pattern in accordance with the present disclosure. The plies are then married to form a multi-ply product. In some embodiments, the plies are concurrently embossed and plied together to form the multi-ply product.

In some embodiments, the product is plied using an adhesive. Any art recognized adhesive or glue can be used to adhere the plies of the multi-ply product. The multi-ply product of the present disclosure can have a ply bond of at least about 1 g, for example from about 1 g to about 40 g, for example at least about 3 g, for example, from about 3 g to about 25 g, for example, from about 1.5 g to about 30 g, for example from about 3 g to about 22 g, for example, from about 6 g to about 15 g. Ply bond is measured according to the following procedure.

Ply bond strengths reported herein are determined from the average load required to separate the plies of two-ply tissue, towel, napkin, and facial finished products using Ply Bond Lab Master Slip & Friction tester Model 32-90, with high-sensitivity load measuring option and custom planar top without elevator available from: Testing Machines Inc. 2910 Expressway Drive South Islandia, N.Y. 11722; (800)-678-3221; testingmachines.com. Ply Bond clamps are available from: Research Dimensions, 1720 Oakridge Road, Neenah, Wis. 54956, Contact: Glen Winkler, Phone: 920-722-2289 and Fax: 920-725-6874. Ply Bond Strength is the average force to separate a 2 layered (plied) finished product of bath tissue or retail towel. The separation of plies is performed in the machine direction over a specified distance between perforations. Samples of retail tissue can be tested at finished product width while retail towel is cut to a 3-in. width. Testing can be performed on a vertical or horizontal type tensile tester that has averaging capabilities. Results are reported as average force/sample width.

Samples are preconditioned according to TAPPI standards and handled only by the edges and corners care being exercised to minimize touching the area of the sample to be tested.

At least ten sheets following the tail seal are discarded. Four samples are cut from the roll thereafter, each having a length equivalent to 2 sheets but the cuts are made ¼" away from the perforation lines by making a first CD cut ¼" before a first perforation and a second CD cut ¼" before the third perforation so that the second perforation remains roughly centered in the sheet. The plies of each specimen are initially separated in the leading edge area before the first perforation continuing to approximately 1 inch past this perforation.

The sample is positioned so that the interior ply faces upwardly, the separated portion of the ply is folded back to a location ½" from the initial cut and ¼" from the first perforation, and creased there. The folded back portion of the top ply is secured in one clamp so that the line contact of the top grip is on the perforation; and the clamp is placed back onto the load cell. The exterior ply of the samples is secured to the platform, aligning the perforation with the line contact of the grip and centering it with the clamp edges.

After ensuring that the sample is aligned with the clamps and perforations, the load-measuring arm is slowly moved to the left at a speed of 25.4 cm/min, for a test length of 16.5 cm and the average load between 5-14 cm on the arm (in g.) is measured and recorded. The average of 3 samples is recorded with the fourth sample being reserved for use in case of damage to one of the first three.

For products having more than two plies follow the same preparation procedure and obtain two samples. Take one sample and test each of the plies starting with the outside ply and removing one sheet at a time until all plies are tested. Each of the individual ply bonds are averaged to obtain the ply bond value in grams. Test the other sample the same way and the average of the two in grams is reported.

The tissue product of the present disclosure has an improved sensory softness. When a sheet is embossed with longer emboss elements, the hands glide over the elements more easily making the tissue product itself feel smoother.

Sensory softness can be determined by using a panel of trained human subjects in a test area conditioned to TAPPI standards (temperature of 71.2° F. to 74.8° F., relative humidity of 48% to 52%). The softness evaluation relied on a series of physical references with predetermined softness values that were always available to each trained subject as they conducted the testing. The trained subjects directly compared test samples to the physical references to determine the softness level of the test samples. The trained subjects assigned a number to a particular paper product, with a higher sensory softness number indicating a higher perceived softness.

Subjective product attributes, such as sensory softness, are often best evaluated using protocols in which a consumer uses and evaluates a product. In a "monadic" test, a consumer will use a single product and evaluate its characteristics using a standard scale. In paired comparison tests, the consumers are given samples of two different products and asked to rate each vis-à-vis the other for either specific attributes or overall preference. Sensory softness is a subjectively measured tactile property that approximates consumer perception of sheet softness in normal use. Softness is usually measured by trained panelists and includes internal comparison among product samples. The results obtained are statistically converted to a useful comparative scale.

The following examples provide representative embodiment patterns according to the present disclosure. The methods and products described herein should not be limited to the examples provided. Rather, the examples are only representative in nature.

EXAMPLE

Two multiply products according to the instant disclosure were made using the tapered configuration of FIGS. 3A-4B and a dual-apex pattern as seen in FIGS. 2A-2D. The control was the same tissue base sheets embossed with the pattern of FIG. 1A, except the elements were kept at a constant line width and with only a single apex. The control was run on a pilot paper line. The control pattern produced an unacceptable product with significant bunching and puckering.

As described above, the patterns as seen in FIG. 1A, while offset from the machine direction, still include significant conforming segments of the continuous emboss elements 20 and the signature elements 30 that align with the MD direction and cause bunching and/or puckering. Both tapering the element and changing the element apex to a dual-apex resulted in a tissue having runnability without significant bunching or puckering.

Although the present disclosure has been described in certain specific exemplary embodiments, many additional modifications and variations would be apparent to those skilled in the art in light of this disclosure. It is, therefore, to be understood that this invention may be practiced otherwise than as specifically described. Thus, the exemplary embodiments of the invention should be considered in all respects to be illustrative and not restrictive and the scope of the invention to be determined by any claims supportable by this application and the equivalents thereof, rather than by the foregoing description.

What is claimed is:

1. A tissue product comprising;

at least one tissue ply comprising a pattern of embossments having at least one conforming embossment having at least one segment that aligns in the machine direction for a distance equal to an aspect ratio of at least 2.5;

wherein the at least one conforming embossment has a base and an apex;

wherein the conforming embossment has a length;

wherein the apex of the conforming embossment has a width; and wherein the at least one conforming embossment comprises at least one of a taper varying the width of the apex such that the width of the apex narrows to a narrowest portion and widens to a widest portion along at least one portion of the length of the conforming embossment or at least one channel running the length of the conforming embossment dividing the apex into at least two sections.

2. The tissue product of claim 1, wherein the at least one ply has a MD elongation stretch from about 10% to about 40%.

3. The tissue product of claim 1, wherein the at least one conforming embossment comprises a taper varying the width of the apex from a narrowest portion to a widest portion.

4. The tissue product of claim 1, wherein the at least one conforming embossment comprises at least one channel running the length of the conforming embossment dividing the apex into at least two sections.

5. The tissue product of claim 1, wherein the at least one conforming embossment comprises a taper varying the width of the apex and at least one channel running the length of the conforming embossment dividing the apex into at least two sections.

6. The tissue product of claim 3, wherein the width of the apex of the conforming embossment at the narrowest portion is at least about 5% less than the width of the apex at the widest portion.

7. The tissue product of claim 3, wherein the width of the apex of the conforming embossment at the narrowest portion is at least about 15% less than the width of the apex at the widest portion.

8. The tissue product of claim 3, wherein the taper repeats along the length of the conforming embossment at an interval of at least about 2.5.

9. The tissue product of claim 3, wherein the taper repeats along the length of the conforming embossment at an interval of at least about 5.

10. The tissue product of claim 4, wherein the at least one conforming embossment comprises one channel running the length of the conforming embossment dividing the apex into two sections.

11. The tissue product of claim 4, wherein the at least one conforming embossment comprises two channels running the length of the conforming embossment dividing the apex into three sections.

12. The tissue product of claim 4, wherein the width of the at least one channel is at least about 10% of the total width of the apex.

13. The tissue product of claim 4, wherein the width of the at least one channel is at least about 35% of the total width of the apex.

14. The tissue product of claim 4, wherein the width of the at least one channel is from about 20% to about 50% of the total width of the apex.

15. The tissue product of claim 1, wherein the at least one conforming embossment is a continuous embossment.

16. The tissue product of claim 1, wherein the at least one conforming embossment comprises a series of continuous embossments that form a series of cells.

17. The tissue product of claim 1, wherein the at least one segment aligns in the machine direction for a distance equal to an aspect ratio of at least 3.5.

18. The tissue product of claim 1, wherein the at least one segment aligns in the machine direction for a distance equal to an aspect ratio of at least 5.

19. The tissue product of claim 1, wherein the product comprises at least one second tissue ply bonded to the at least one first tissue ply by adhesive.

20. The tissue product of claim 19, wherein the at least one conforming embossment of the at least one first tissue ply comprises at least one channel running the length of the conforming embossment dividing the apex into at least two sections, and wherein the at least one first tissue ply is bonded to the at least one second tissue ply by adhesive applied to the at least two sections of the apex.

21. The tissue product of claim 15, wherein the continuous embossment is not broken into smaller elements.

* * * * *